US008411098B2

(12) United States Patent
Harris et al.

(10) Patent No.: US 8,411,098 B2
(45) Date of Patent: Apr. 2, 2013

(54) DISPLAY DEVICE MODULATION SYSTEM

(75) Inventors: Franklin W. Harris, Raleigh, NC (US); Howell J. Chambers, Jr., Wake Forest, NC (US); Joseph C. Ninan, Durham, NC (US); James A. North, Raleigh, NC (US); Thomas A. Vanderkin, Raleigh, NC (US)

(73) Assignee: Lenovo (Singapore) Pte. Ltd., Singapore (SG)

( * ) Notice: Subject to any disclaimer, the term of this patent is extended or adjusted under 35 U.S.C. 154(b) by 1045 days.

(21) Appl. No.: 11/865,053

(22) Filed: Sep. 30, 2007

(65) Prior Publication Data

US 2009/0085922 A1 Apr. 2, 2009

(51) Int. Cl.
*G09G 5/00* (2006.01)

(52) U.S. Cl. ..... 345/581; 345/619; 345/207; 345/690; 345/214; 348/602; 348/603; 348/658

(58) Field of Classification Search ..... None
See application file for complete search history.

(56) References Cited

U.S. PATENT DOCUMENTS

| | | | | |
|---|---|---|---|---|
| 6,618,045 | B1 | 9/2003 | Lin | |
| 6,624,828 | B1 * | 9/2003 | Dresevic et al. | 715/771 |
| 7,330,189 | B2 * | 2/2008 | Nichogi et al. | 345/589 |
| 7,786,851 | B2 * | 8/2010 | Drew et al. | 340/438 |
| 7,836,409 | B2 * | 11/2010 | Denoue et al. | 715/789 |
| 2003/0085870 | A1 * | 5/2003 | Hinckley | 345/156 |
| 2007/0027628 | A1 * | 2/2007 | Geelen | 701/213 |
| 2007/0146356 | A1 * | 6/2007 | Ladouceur | 345/207 |
| 2008/0303825 | A1 * | 12/2008 | Clegg et al. | 345/471 |

* cited by examiner

*Primary Examiner* — Antonio A Caschera
(74) *Attorney, Agent, or Firm* — Ference & Associates LLC

(57) ABSTRACT

Arrangements and methods are provided that modulate various display device outputs in response to detected changes in environmental conditions affecting a display screen. The arrangement responds to changing environments to maximize the quality of the display. A sensor that is responsive to the changing environment, such as changes in ambient light, is provided to modulate the display accordingly. The arrangement contains logic for utilizing the sensing input and user preferences to provide the best display under the prevailing conditions.

18 Claims, 3 Drawing Sheets

DISPLAY DEVICE MODULATION SYSTEM

FIELD OF THE INVENTION

The present invention relates to systems, arrangements and methods for modulating display devices to accommodate changes in environmental settings so as to maximize the visibility of the display.

BACKGROUND OF THE INVENTION

The use of computing devices having a display screen has increased greatly in the recent past and this trend is likely to continue. As use of traditional computing devices, such as desktop or laptop computers increases, and the mobility of computing devices increases, users of such devices will increasingly face situations where unusual and less-than ideal viewing environments are encountered, rendering the display screen unreadable. Moreover, as existing mobile devices, such as PDAs (Personal Digital Assistants) and cellular phones, take on new computing functions that require more elaborate displays, users of these devices will likewise encounter less than ideal viewing environments impacting the visibility and readability of the display screen.

Users encounter less than ideal viewing environments, for example, when the users are employing devices in environments where there is a less than an ideal lighting. There are numerous situations in which it is desirable to use a device where there is less than ideal lighting. For example, when working with a device containing a display screen, such as an LCD (Liquid Crystal Display) screen, in an environment with an over abundance of light, such as when working on a laptop computer outdoors, a common problem that is encountered is that the display screen frequently becomes unreadable due to an over-abundance of ambient light. Other users may in some circumstances frequently use machines that are located in environments having less than ideal lighting, for example, outdoor environments, as when servicing vehicles, or in offices or workspaces with windows exposed to sunlight or bright interior lights. Alternatively, users may periodically encounter unusual lighting environments, as when using a mobile device, such as a laptop or PDA, while travelling or working outdoors for a short period. As the mobility of devices increases, the problem of encountering usual lighting environments will likely increase as well. Whatever the particular reason for encountering an unusual and less than ideal lighting environment, users tend to become frustrated and are inconvenienced when such difficulties using the devices are encountered.

In many of these problematic situations, the display screen simply becomes unreadable because the display screen is not appropriately adjusted such that it accommodates the unusual lighting of the environment. For example, in an environment with bright light, such as an outdoor courtyard or an office with a window exposed to sunlight, a user's computer display screen may be unreadable in part because the display screen is not bright enough, as it has been set to a brightness appropriate for indoor use.

Prior solutions have focused on managing screen brightness, color and contrast, often in an effort to maximize performance and power conservation, or some combination of these two. Prior solutions to varying display screen brightness have particularly focused on power conservation schemes, where the display screen may be dimmed to conserve power in a low-light environment. Alternatively, it is common that the brightest possible setting for the display screen will be used, as when an excess of ambient light is encountered. Still other solutions are provided wherein a device is added to the computer to reduce glare in abundant light conditions. Whatever the various prior solutions to managing display screens have offered, they do not contemplate increasing the readability and usability of the display screen beyond modulating the brightness, contrast and color of the screen, which are often ineffective. Therefore, a need has arisen to increase the visibility, readability and usability of device display screens to overcome the above deficiencies.

SUMMARY OF THE INVENTION

In accordance with at least one presently preferred embodiment of the present invention, there is broadly contemplated a system and method for an improvement of a display screen to overcome the problems associated with using electronic devices in unusual lighting environments.

In summary, one aspect of the invention provides an apparatus comprising: a display device, wherein the display device comprises: an arrangement adapted to ascertain at least one environmental condition; and an arrangement adapted to modulate at least one display setting of the display device, wherein the at least one display setting comprises at least one operating system setting and is modulated based on the at least one ascertained condition.

Another aspect of the invention provides a system comprising: a computer having a processor and a memory; a display device operatively connected to the computer; an arrangement adapted to ascertain at least one environmental condition; and an arrangement adapted to modulate at least one display setting of the display device, wherein the at least one display setting comprises at least one operating system setting and is modulated based on the at least one ascertained condition.

Another aspect of the invention provides a method comprising: ascertaining at least one environmental condition; modulating at least one display setting of a display device based upon the at least one ascertained environmental condition; wherein the at least one display setting to be modulated comprises at least one operating system setting selected from the group consisting of an inverse font setting, an inverse display setting, an enlarged text setting, and a display zoom setting.

Another aspect of the present invention provides a computer readable medium readable by a computer tangibly embodying a program of instructions executable by the computer to perform method steps for modulating at least one operating system setting of a display device, said method comprising the steps of: ascertaining at least one environmental condition; modulating at least one display setting of a display device based upon the at least one ascertained environmental condition; wherein the at least one display setting to be modulated comprises at least one operating system setting selected from the group consisting of an inverse font setting, an inverse display setting, an enlarged text setting, and a display zoom setting.

For a better understanding of the present invention, together with other and further features and advantages thereof, reference is made to the following description, taken in conjunction with the accompanying drawings, and the scope of the invention will be pointed out in the appended claims

DETAILED DESCRIPTION OF THE PREFERRED EMBODIMENTS

Figure 1:
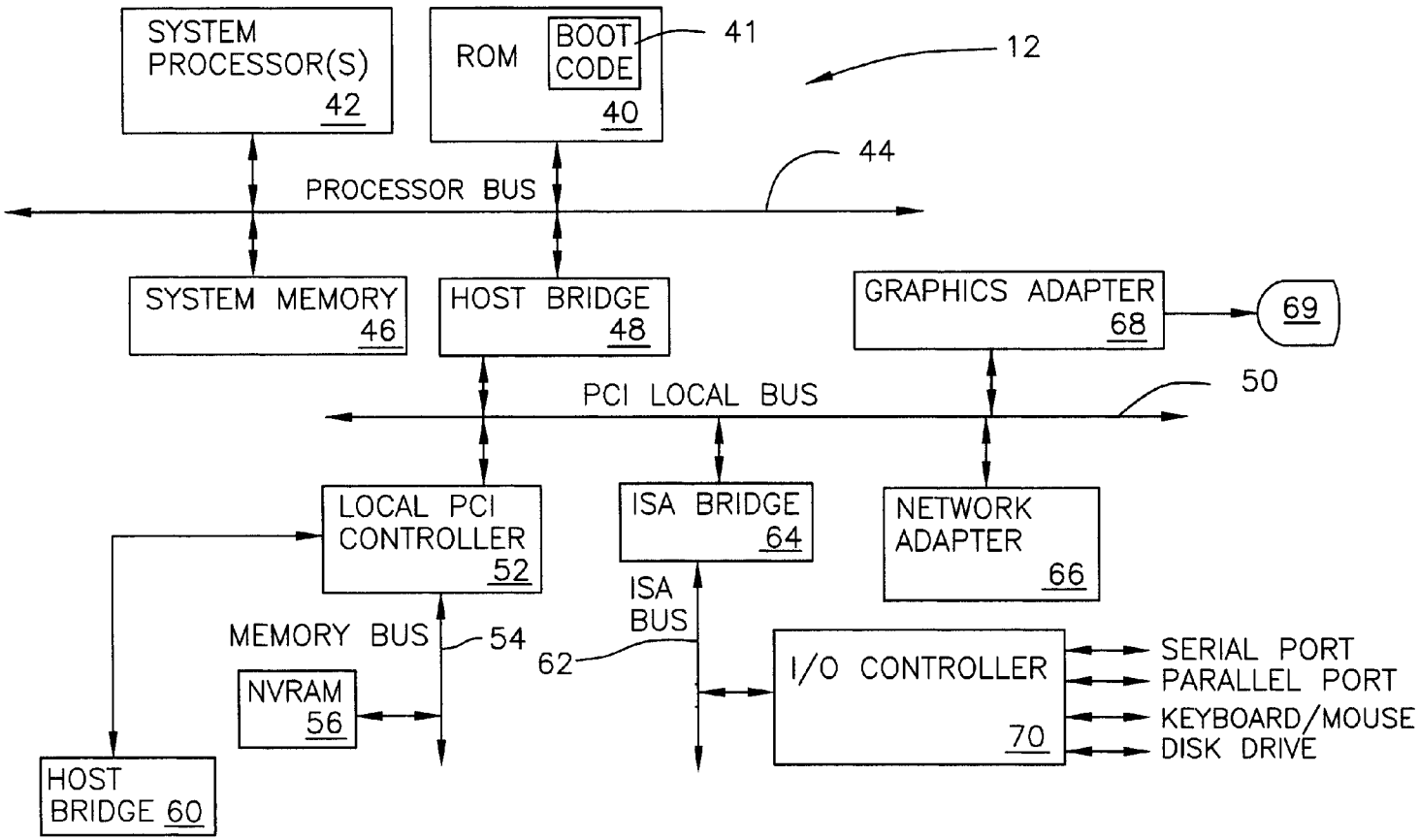
FIG. 1 is an illustration of a computer system.

The invention will first be described by way of a general description and then a more detailed description, with reference to the drawings, will be given.

It will be readily understood that the components of the present invention, as generally described and illustrated in the Figures herein, may be arranged and designed in a wide variety of different configurations. Thus, the following more detailed description of the embodiments of the apparatus, system, and method of the present invention, as represented in the Figures is not intended to limit the scope of the invention, as claimed, but is merely representative of selected embodiments of the invention.

Reference throughout this specification to "one embodiment" or "an embodiment" (or the like) means that a particular feature, structure or characteristic described in connection with the embodiment is included in at least one embodiment of the present invention. Thus, appearances of the phrases "in one embodiment" or "in an embodiment" (or the like) in various places throughout this specification are not necessarily all referring to the same embodiment.

Furthermore, the described features, structures, or characteristics may be combined in any suitable manner in one or more embodiments. In the following description, numerous specific details are provided to give a thorough understanding of the embodiments of the invention. One skilled in the relevant art will recognize, however, that the invention can be practiced without one or more of the specific details, or with other methods, components, materials, etc. In other instances, well-known structures, materials, or operations are not shown or described in detail to avoid obscuring aspects of the invention.

The illustrated embodiments of the invention will be best understood by reference to the drawings. The following description is intended only by way of example, and simply illustrates certain selected embodiments of devices, systems and processes that are consistent with the invention as claimed herein.

According to one embodiment of the present invention, a system is provided for managing the visibility and the readability of a display device, such as a display screen on a laptop computer, by modulating operating system settings, in addition to display screen settings (e.g. brightness, color and contrast), to accommodate changes in the prevailing viewing conditions, such as the amount of ambient light in a particular location, thus optimizing the display screen appearance. The system increases the overall usability of the display screen by employing a sensor as a hardware platform to detect conditions, such as levels of ambient light in the surrounding environment. The sensor is coupled to a control unit that implements software and effects changes to the operating system settings and applications settings of the display device, based on the detected environmental condition, such as the amount of ambient light, thus increasing the visibility of the display screen contents. The software is capable of, for example, interpreting data output by a light sensor (a light sensor detected light value) and adjusting automatically certain operating system settings to improve visibility of the display screen.

Outside of LCD brightness, the operating system settings to be modulated by the system include, for example, modulation of the resolution of the display, modulation of the font size used, inverting the font or text of the either part of or the entire display, modulating the contrast, color and hue of the display and desktop zoom. All of these modulations are conducted by the system in an effort to increase the visibility of the display device when unusual lighting environments are encountered, thereby increasing the readability of the screen and increasing the device's usability by enabling a user to see the contents of the display screen more clearly.

Preferably the user can create and edit display settings profiles (preferences) in order to adjust what actions the system takes. For example, the user can control what action the system takes at a particular light level or geographic location detected by the sensor, or manually direct the system to take certain actions independent of the sensor detected values.

The following description particularly focuses on an embodiment of the invention wherein the display device having the display screen is a laptop computer and furthermore wherein the environmental condition is an overabundance of light. It will be readily understood, however, by one having ordinary skill in the relevant art that the device may be any device, including mobile devices and fixed devices, that employ display screens or display technology, such as for example an LCD or projection type screen, that are capable of modulation as described above. Non-exhaustive examples of such devices include, laptop computers, PDAs, cell phones, desktop computers, conference room projector arrangements, etc. Moreover, as will be pointed out below, the environmental condition may be detection of a particular geographic location, as by detecting particular network connections.

Referring now to FIG. 1, there is depicted a block diagram of an illustrative embodiment of a computer system 12. The illustrative embodiment depicted in FIG. 1 may be a notebook computer system, such as one of the ThinkPad® series of personal computers or the ThinkCentre® workstation computers sold by Lenovo (US) Inc. of Morrisville, N.C., however, as will become apparent from the following description, the present invention is applicable to any data processing system.

As shown in FIG. 1, computer system 12 includes at least one system processor 42, which is coupled to a Read-Only Memory (ROM) 40 and a system memory 46 by a processor bus 44. System processor 42, which may comprise one of the AMD™ line of processors produced by AMD Corporation or a processor produced by Intel Corporation, is a general-purpose processor that executes boot code 41 stored within ROM 40 at power-on and thereafter processes data under the control of operating system and application software stored in system memory 46. System processor 42 is coupled via processor bus 44 and host bridge 48 to Peripheral Component Interconnect (PCI) local bus 50.

PCI local bus 50 supports the attachment of a number of devices, including adapters and bridges. Among these devices is network adapter 66, which interfaces computer system 12 to LAN 10, and graphics adapter 68, which interfaces computer system 12 to display 69. Communication on PCI local bus 50 is governed by local PCI controller 52, which is in turn coupled to non-volatile random access memory (NVRAM) 56 via memory bus 54. Local PCI controller 52 can be coupled to additional buses and devices via a second host bridge 60.

Computer system 12 further includes Industry Standard Architecture (ISA) bus 62, which is coupled to PCI local bus 50 by ISA bridge 64. Coupled to ISA bus 62 is an input/output (I/O) controller 70, which controls communication between computer system 12 and attached peripheral devices such as a keyboard, mouse, and a disk drive. In addition, I/O controller 70 supports external communication by computer system 12 via serial and parallel ports.

Figure 2:
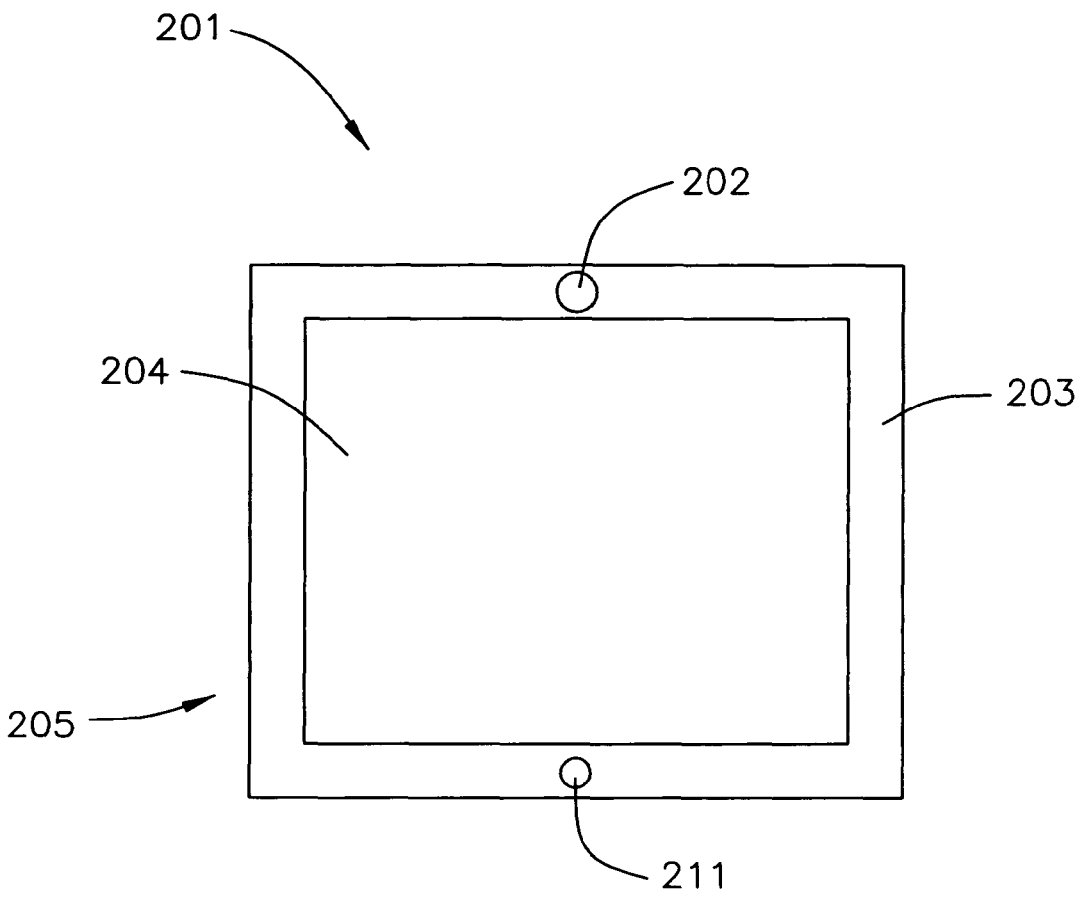
FIG. 2 is an illustration of a display device.

As shown in FIG. 2, a display device 201 contains a light sensor 202 located in close proximity to the screen 204 within a housing 203 surrounding the screen. The display device 201 receives input 205 from the computer system 12 in order to control the display on the screen by modulating the operating system settings. The display housing 203 also contains a user interface 211 for manually adjusting certain display settings, such as contrast, color and brightness. The input 205 used to modulate the operating system settings displayed upon the screen 204 is described below.

Figure 3:
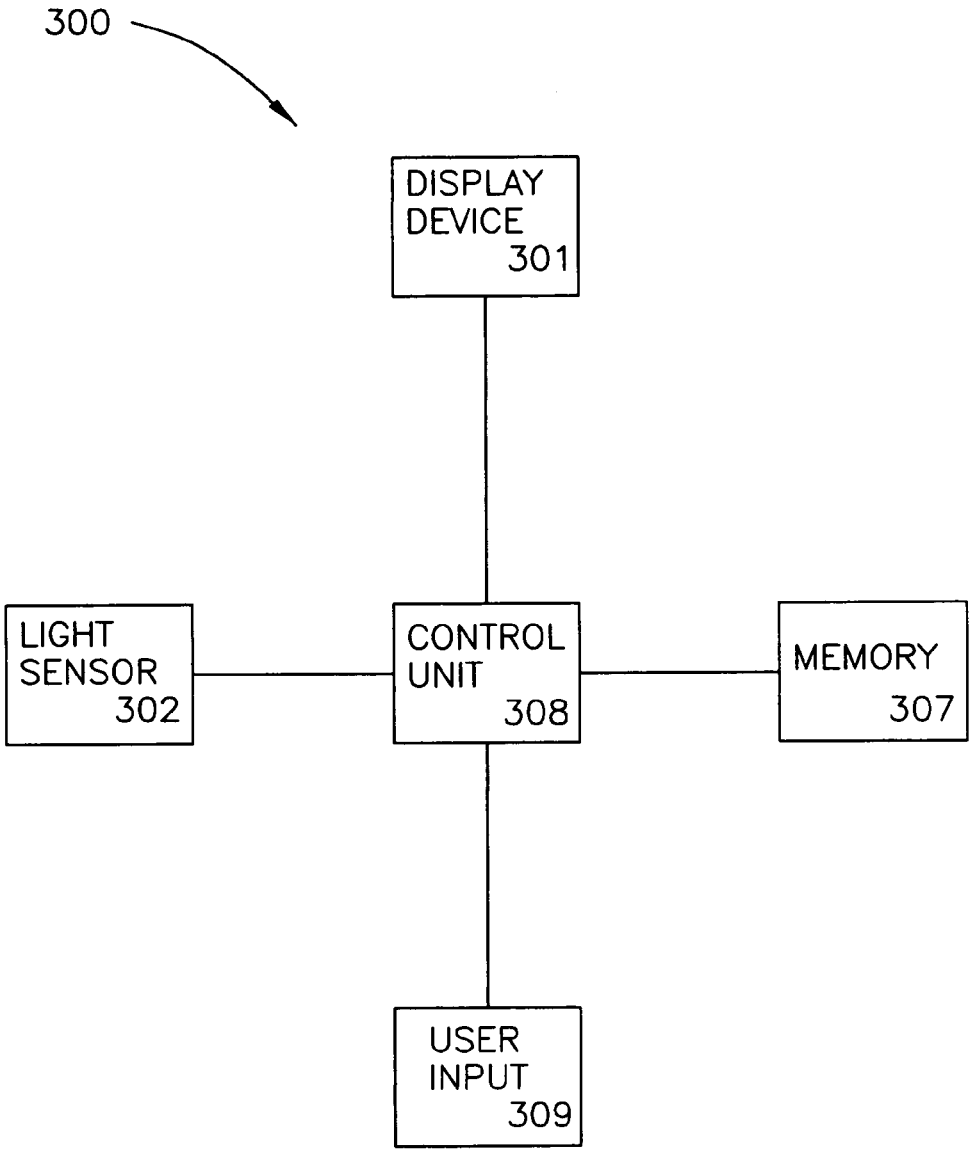
FIG. 3 is an illustration of a display modulation system.

In FIG. 3 a display modulation system 300 has a control unit 308, preferably as part of a computer, that receives input from a light sensor 302 and optionally a memory 307 and an arrangement configured to receive user input 309. For demonstration purposes, in FIG. 3 the light sensor 302 is shown separately from the display device 301, however, it is to be understood that the light sensor may be incorporated as part of the overall display device, as shown in FIG. 2. The control unit 308 is adapted to execute software that interprets the various inputs from the light sensor 302, the user 309, and the memory 307 to select preferred operation system settings to be output to the display device 301.

In one embodiment of the invention, the light sensor 202 is coupled to a laptop computer 12. Preferably, the light sensor 202 is located in close proximity to the display screen 204 of the computer 12 and oriented and configured in order to ensure that the light sensor 202 is capable of detecting and providing the most accurate reading of ambient light affecting the display screen 204. The light sensor 202 may be adapted such that its physical orientation and reception settings capture the most relevant portion of incoming ambient light (for example the proper incident angle and spectrum) affecting the display screen 204.

The light sensor 302 produces an output value corresponding to the amount of detected ambient light. This output is provided to the control unit 308. Preferably the light sensor 302 is capable of sensing and producing information regarding different levels or gradients of ambient light intensity and providing this information to the laptop computer 12, for example by providing an output to a control (logic) unit 308 of the computer 12. Suitable light sensors are well known in the art and one of ordinary skill in the art will recognize that any suitable light sensor may be used.

The light sensor 302 provides the information output to the computer control 308 (for example, a programmable processor) on a cycle. The frequency or rate of measurements of the ambient light by the sensor 302 should be such that the measurements of the ambient light and the provision of such measurements in the form of sensor output values to the computer 12 provide sufficient information regarding the ambient light in order to appropriately modify the operating system settings affecting the display screen 204 and provide the most visible, readable display to the user. The measurement of light by the sensor 302 may be continuous or on a fixed, periodic schedule. Preferably, the light sensor 302 measures light in as continuous a manner as is possible given other considerations, for example power use considerations, such that a dynamically changing light environment will be readily and automatically manageable by the display modulation system 300. Preferably the frequency of the light measurements/readings and outputs are controlled by software implemented on and executable by the computer 12. Preferably, the light sensor 302 measures and provides information regarding ambient light on a continuous basis in order to facilitate rapid changes in the settings affecting the display screen 204 in response to a dynamically changing light environment.

The output reading from the light sensor 302 is provided to the computer 12 containing a control unit 308 capable of utilizing such information. For example, software executable by the computer is capable of utilizing the information regarding ambient light, provided by the light sensor 302 in the form of a sensor output, to select operating system settings, or group of settings, to be modulated in order to increase the visibility and thus the readability and usability of the display screen 204 and computer 12, respectively.

Non-exhaustive examples of operating settings affecting the display screen's 204 visibility that can be modulated based upon, for example, an over abundance of detected ambient light, are described below. As an initial matter, the light sensor 302 will detect an over abundance of ambient light (e.g. over a threshold value) and provide this information to the control unit 308. The control unit 308 interprets the input from the light sensor 302 as indicating an over abundance of light and implements changes to operating system settings to counteract the over abundance of light.

The control unit 308 may affect the following adjustments to the operating system settings to improve the display provided on the screen 204 of the display device 201. The display may be inverted, either as to the whole display or part of the display, such that the negative image of the display is produced upon the screen. Also, the system 300 may selectively invert the display of an application currently being utilized, while not inverting the display of other, background applications appearing on the screen. Furthermore, the system 300 may decrease the resolution of the display screen 204, either in whole or in part, thus increasing, for example, the font size of text displayed on the screen. Additionally, the system 300 may zoom in on and magnify a particular area of interest within the display screen 204, such as an area of the display currently being utilized by the user. Additional settings may also be modulated as by adjusting the brightness, hue, color and contrast of the overall display itself, or any particular portion thereof (e.g. the portions of the screen representing applications currently being utilized by a user). Moreover, application settings of the computer's 12 programs may themselves be selectively modulated. For example, in an email application, all but the essential information could be minimized or de-emphasized, as by decreasing their size, while the essential information (e.g. certain buttons and controls) could be maximized, as by having their size increased, thus increasing the overall visibility and readability of the essential display elements needed by the user. It will be understood by one having ordinary skill in the art that the changes in operating system settings executed by the control unit can be done incrementally, i.e. the changes are not necessarily implemented on an all or nothing basis.

In one embodiment of the invention, the modulation of the operating system settings may be tied into and take account of other considerations that affect the overall performance of the computer 12, such as a user preference or the contextual setting in which the computer 12 is being used. For example, a user in an indoor office setting, where changes in ambient light are not frequently encountered, may create an indoor preference regarding operating system settings, and implement this preference and forego the use of the automated display modulation system, either in whole or in part. Alternatively, a user of a mobile device may wish to enable the display modulation system to maximize the display settings due to frequently encountering changing light environments.

Furthermore, automatically detected environmental or geographic locations may be utilized to modulate the operability of the display modulation system, either alone or in addition to the light sensor and preference inputs. This may occur, for example, when a particular network is detected, and based on the network detection (e.g. the address of a wired router or an SSID (Service Set Identifier) of a wireless access point) the display modulation system is employed accordingly. For example, the detection of a known mobile geographic location, for example when an known wireless router is detected, may be utilized by the control unit 308 to implement a mobile preference setting saved to memory 307 by the user and corresponding to the mobile setting (e.g. user saves a mobile preference of adjusted operating system settings adapted to maximize outdoor visibility of the screen for this particular location context).

The user of the computer 12 may alternatively manually modulate the operability of the display modulation system. The user may affect such control by providing user input 309 to turn the system on or off, either in whole or in part (e.g. turning the light sensor off and having the user manually indicate the intensity of the light), or to select particular settings from a predetermined or user created set of display settings stored in a memory 307, such as a computer memory or an external memory storage medium. The user may alternatively manually modulate the operating system settings themselves using a user input 309 of a preference (e.g. more or less zoom as indicated by a user input). For example, the user may prefer the inverted text function over the zoom function and preferably turn off the zoom function and leave the inverted text function enabled. It will be readily understood by one having ordinary skill in the art that the degree to which a user relies on the automatic modulation employed by the display modulation system will depend on the individual user's preferences and the unique environments encountered by a particular user.

A user may also create and save preferred display settings to memory 307 which can be loaded at the user's discretion. To accomplish this, the user may for example save settings that are automatically provided by the display modulation system and deemed by the user as particularly appropriate for any given lighting or geographic condition. Upon saving the preferred setting to the memory, it can easily be loaded by the system either automatically when that condition is again encountered (as detected by the system) or at the user's discretion (by way of manual user input). Additionally, the system may contain pre-selected preferred settings (e.g. indoor/day and outdoor/day, outdoor/night) that are stored in memory 307 from which users may choose.

It is to be understood that the present invention, in accordance with at least one preferred embodiment, includes a system for modulating a display device by sensing environmental conditions with a sensor, providing an output from the sensor, corresponding for example to the detected ambient light, to a computer logic capable of utilizing the sensor output to modulate operating system settings in order to maximize the display screen visibility. The invention may be implemented on at least one general-purpose computer running suitable software programs. The invention may also be implemented on at least one Integrated Circuit or part of at least one Integrated Circuit. Thus, it is to be understood that various aspects of the invention may be implemented in hardware, software, or a combination of both.

If not otherwise stated herein, it is to be assumed that all patents, patent applications, patent publications and other publications (including web-based publications) mentioned and cited herein are hereby fully incorporated by reference herein as if fully set forth in their entirety herein.

Although illustrative embodiments of the present invention have been described herein with reference to the accompanying drawings, it is to be understood that the invention is not limited to those precise embodiments, and that various other changes and modifications may be affected therein by one skilled in the art without departing from the scope or spirit of the invention.

What is claimed is:

1. An apparatus comprising:

a display device, wherein the display device comprises:

an arrangement adapted to ascertain at least one environmental condition, the at least one environmental condition comprising ambient light; and an arrangement adapted to modulate at least one display setting of the display device based on the at least one environmental condition;

wherein the at least one display setting comprises an operating system setting selected from a group consisting of a resolution setting, an inverse font setting, an inverse display setting, an enlarged text setting, and a display zoom setting: and wherein the at least one environmental condition further comprises a geographic location based on detection of at least one network.

2. The apparatus according to claim 1 wherein the display device is a monitor arrangement of a computer.

3. The apparatus according to claim 1, wherein the detection of at least one network comprises ascertaining a service set identifier (SSID) associated with a wireless network.

4. The apparatus according to claim 1, wherein the at least one display setting further comprises at least one application setting.

5. The apparatus according to claim 4, wherein the at least one application setting comprises at least one element of essential information;

wherein modulating at least one display setting of the display device based on the at least one environmental condition comprises maximizing the at least one element of essential information and minimizing one or more elements of non-essential information.

6. The apparatus according to claim 1, wherein to modulate the display zoom setting comprises zooming in on and magnifying a particular area of interest within the display device.

7. The apparatus according to claim 6, wherein the particular area of interest within the display device comprises an actively utilized area of the display device.

8. A system comprising:

a computer having a processor and a memory;

a display device operatively connected to the computer;

an arrangement adapted to ascertain at least one environmental condition, the at least one environmental condition comprising ambient light; and an arrangement adapted to modulate at least one display setting of the display device based on the at least one environmental condition;

wherein the at least one display setting comprises at least one of: an operating system setting and an application setting;

wherein the at least one operating system display setting is selected from a group consisting of a resolution setting, an inverse font setting, an inverse display setting, an enlarged text setting, and a display zoom setting; and wherein the at least one environmental condition further comprises a geographic location based on detection of at least one network.

9. The system according to claim 8 further comprising a memory adapted to store at least one user display setting preference, wherein the at least one display setting is modulated to conform to the at least one user display setting preference.

10. The system according to claim 9 wherein the at least one user display setting preference is adapted to compensate for a bright light environment.

11. The system according to claim 9, wherein the at least one user display setting preference comprises a mobile setting, an indoor setting, and an outdoor setting.

12. The system according to claim 8 wherein the display device is a monitor arrangement of a computer.

13. The system according to claim 8, wherein the at least one environmental condition further comprises a geographic location.

14. A method comprising:

providing a display device having a sensor;

ascertaining at least one environmental condition utilizing the sensor;

configuring an arrangement to modulate at least one display setting of the display device based upon the at least one ascertained environmental condition;

wherein the at least one display setting to be modulated comprises at least one operating system setting selected from the group consisting of a resolution setting, an inverse font setting, an inverse display setting, an enlarged text setting, and a display zoom setting; and wherein the at least one environmental condition comprises a geographic location based on detection of at least one network.

15. The method according to claim 14 wherein the at least one ascertained environmental condition is ambient light.

16. The method according to claim 15 wherein the at least one ascertained environmental condition further comprises a geographic location.

17. The method according to claim 14 wherein the at least one operating system setting is modulated base upon a stored user display setting preference.

18. A computer readable medium readable by a computer tangibly embodying a program of instructions executable by the computer to perform modulating at least one operating system setting of a display device, said method comprising:

ascertaining at least one environmental condition;

modulating at least one display setting of a display device based upon the at least one ascertained environmental condition;

wherein the at least one display setting to be modulated comprises at least one operating system setting selected from the group consisting of a resolution setting, an inverse font setting, an inverse display setting, an enlarged text setting, and a display zoom setting; and wherein the at least one environmental condition comprises a geographic location based on detection of at least one network.

* * * * *